US009074529B2

(12) United States Patent
Kawasumi

(10) Patent No.: US 9,074,529 B2
(45) Date of Patent: Jul. 7, 2015

(54) DRIVE CONTROLLING APPARATUS AND DRIVE CONTROLLING METHOD

(75) Inventor: Shinji Kawasumi, Hanno (JP)

(73) Assignee: Shindengen Electric Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/981,898

(22) PCT Filed: Jun. 26, 2012

(86) PCT No.: PCT/JP2012/066253

§ 371 (c)(1),
(2), (4) Date: Jul. 25, 2013

(87) PCT Pub. No.: WO2014/002185

PCT Pub. Date: Jan. 3, 2014

(65) Prior Publication Data

US 2014/0014064 A1 Jan. 16, 2014

(51) Int. Cl.

| | |
|---|---|
| ***F02B 75/02*** | (2006.01) |
| ***F02D 41/00*** | (2006.01) |
| ***F02N 19/00*** | (2010.01) |

(52) U.S. Cl.

CPC ..... *F02B 75/02* (2013.01); *F02D 41/009* (2013.01); *F02N 19/005* (2013.01); *F02D 2041/0092* (2013.01)

(58) Field of Classification Search

CPC . F02N 19/005; F02N 2200/021; F02N 11/08; F02N 2300/104; F02D 28/00

USPC ..... 123/311, 339.1, 339.14, 179.3, 179.5; 701/101–107

See application file for complete search history.

(56) References Cited

U.S. PATENT DOCUMENTS

| | | | | |
|---|---|---|---|---|
| 5,284,116 | A * | 2/1994 | Richeson, Jr. | 123/406.2 |
| 6,807,934 | B2 * | 10/2004 | Kataoka et al. | 123/179.4 |
| 6,877,470 | B2 * | 4/2005 | Mitani et al. | 123/179.3 |
| 7,443,044 | B2 * | 10/2008 | Shimazaki et al. | 290/38 R |
| 7,949,461 | B2 * | 5/2011 | Takahashi | 701/113 |
| 8,498,801 | B2 * | 7/2013 | Nagatsuyu et al. | 701/112 |
| 2004/0060530 | A1 * | 4/2004 | Mitani et al. | 123/179.3 |
| 2004/0149247 | A1 * | 8/2004 | Kataoka et al. | 123/179.4 |
| 2006/0081207 | A1 * | 4/2006 | Nakamura | 123/179.3 |
| 2010/0030455 | A1 * | 2/2010 | Akimoto | 701/111 |

(Continued)

FOREIGN PATENT DOCUMENTS

| | | |
|---|---|---|
| JP | H03-003969 | 1/1991 |
| JP | H07-071350 | 3/1995 |

(Continued)

OTHER PUBLICATIONS

International Search Report for PCT/JP2012/0066253, mailed on Jul. 31, 2012.

*Primary Examiner* — Lindsay Low
*Assistant Examiner* — Long T Tran
(74) *Attorney, Agent, or Firm* — Ladas & Parry, LLP

(57) ABSTRACT

According to a drive controlling method, the engine is driven in the forward direction by a predetermined reference torque, and the position of the rotation angle of the engine driven in the forward direction is judged based on information concerning whether the rotation angle has passed through the first top dead center in the forward movement of the engine, the amount of forward movement of the engine driven in the forward direction and the amount of reverse movement of the engine driven in the reverse direction.

9 Claims, 18 Drawing Sheets

(56) References Cited

U.S. PATENT DOCUMENTS

| | | | | |
|---|---|---|---|---|
| 2013/0179055 | A1* | 7/2013 | Kato et al. | 701/113 |
| 2013/0180490 | A1* | 7/2013 | Odahara et al. | 123/179.4 |

FOREIGN PATENT DOCUMENTS

| | | |
|---|---|---|
| JP | 2009-074515 | 4/2009 |
| JP | 2012-097600 | 5/2013 |

* cited by examiner

DRIVE CONTROLLING APPARATUS AND DRIVE CONTROLLING METHOD

CROSS REFERENCE TO RELATED APPLICATION

This application is the national stage of International Patent Application no. PCT/JP2012/066253, filed on Jun. 26, 2012, the disclosure of which is incorporated herein in its entirety.

TECHNICAL FIELD

The present invention relates to a drive controlling apparatus and a drive controlling method.

BACKGROUND ART

When an engine starts, a starter or other rotating power outputting means drives the crank shaft of the engine to rotate. At this time, frictions in the engine and the compression pressure in the cylinder, particularly the compression pressure in the compression stroke, act as a resistance to the rotation. If the resistance to the rotation is too large, the engine may stop rotating immediately before the top dead center in the cylinder in the compression stroke and fail to start. In particular, in hot start, the compression pressure significantly increases, so that the start failure is likely to occur.

To avoid the start failure, there is a technique of making the rotating power outputting means intermittently apply the torque in the forward direction or alternately apply the torque in the forward direction and the reverse direction when the engine stops rotating during start (see JP03-3969A, for example).

According to the conventional technique, in which the torque is intermittently applied in the forward direction or alternately applied in the forward direction and the reverse direction, the pressure in the cylinder is released when the application of the torque is interrupted, the static friction is changed to the kinetic friction to reduce the frictional force, and an inertia torque is produced, thereby facilitating starting the engine.

There is another technique of making the rotating power outputting means drive the engine in the reverse direction at the beginning of the starting of the engine and then drive the engine in the forward direction (see JP07-71350A, for example).

In this way, the pressure in the cylinder is released when the application of the torque is interrupted, the frictional force is changed from the static frictional force to the kinetic frictional force and thereby reduced, and an inertia torque is produced, thereby facilitating starting the engine.

When an ECU is powered on, there is no information concerning the stroke of the engine at a standstill. According to these conventional techniques, the engine is controlled to start without identifying the current stroke of the engine.

That is, according to these conventional techniques, when the ECU is powered on, the stroke of the engine is not identified before a motor starting control occurs.

The conventional techniques described above do not disclose any method of identifying the state of the engine at a standstill when the ECU is powered on.

Therefore, these conventional techniques cannot be applied as they are to a technique of controlling starting of a motor depending on the stroke of the engine at a standstill, for example.

DISCLOSURE OF THE INVENTION

A drive controlling method according to an embodiment of an aspect of the present invention is a drive controlling method of controlling driving of a four-stroke engine based on a signal output from a sensor that detects a change of a rotation angle and a top dead center of the engine, comprising:

a step of driving the engine in a forward direction by applying a reference torque that exceeds a first top dead center between an exhaust stroke and an intake stroke but does not exceed a second top dead center between a compression stroke and a combustion stroke to the engine in a forward driving control, and then, after the engine stops rotating, judging whether or not the rotation angle has passed through the first top dead center as a result of a forward movement of the engine based on whether a reference position signal that indicates that the rotation angle has passed through the first top dead center is output from the sensor;

a step of, in a case where it is judged that the rotation angle has passed through the first top dead center, judging whether or not an amount of forward movement of the engine driven in the forward direction is equal to or greater than an amount of reverse movement of the engine driven in a reverse direction based on a result of detection of the rotation angle by the sensor;

a step of, in a case where it is judged that the rotation angle has passed through the first top dead center, and the amount of forward movement is equal to or greater than the amount of reverse movement, judging that a current rotation angle of the engine lies in the intake stroke or the compression stroke and is positioned at a rotation angle shifted from the first top dead center by a difference between the amount of forward movement and the amount of reverse movement detected by the sensor;

a step of, in a case where it is judged that the rotation angle has passed through the first top dead center, and the amount of forward movement is not equal to or greater than the amount of reverse movement, judging that the current rotation angle of the engine lies in the combustion stroke or the exhaust stroke and is positioned at a rotation angle shifted from the first top dead center by the difference between the amount of forward movement and the amount of reverse movement detected by the sensor;

a step of, in a case where it is judged that the rotation angle has not passed through the first top dead center, judging whether or not the amount of forward movement of the engine driven in the forward direction is equal to or greater than the amount of reverse movement of the engine driven in the reverse direction based on a result of detection of the rotation angle by the sensor;

a step of, in a case where it is judged that the rotation angle has not passed through the first top dead center, and the amount of forward movement is equal to or greater than the amount of reverse movement, judging that the current rotation angle of the engine lies in the intake stroke or the compression stroke and is positioned at a rotation angle shifted from a rotation angle shifted from the first top dead center in the forward direction by a first correction amount by the difference between the amount of forward movement and the amount of reverse movement detected by the sensor; and a step of, in a case where it is judged that the rotation angle has not passed through the first top dead center, and the amount of forward movement is not equal to or greater than the amount of reverse movement, judging that the current rotation angle of the engine is positioned at a rotation angle shifted from the second top dead center in the reverse direction by a second correction amount by the difference between the amount of forward movement and the amount of reverse movement detected by the sensor.

In the drive controlling method, the drive controlling method may further comprise:

a step of starting the forward driving control to start applying a torque to the engine from a motor a rotating shaft of which is connected to a crank shaft of the engine;

a step of starting measuring a torque application time from the start of application of the torque to the engine;

a step of judging whether or not an rotation number of the engine detected by the sensor has reached a target value;

a step of, in a case where it is judged that the rotation number of the engine has not reached the target value, judging whether or not the torque application time has reached a set time; and a step of, in a case where it is judged that the rotation number of the engine has reached the target value or in a case where it is judged that the torque application time has reached the set time, stopping the forward driving control to stop application of the torque from the motor to the engine.

In the drive controlling method, wherein in a case where it is judged that the torque application time has not reached the set time, the drive controlling method may return to the step of judgment of whether or not the rotation number of the engine detected by the sensor has reached the target value.

In the drive controlling method, the drive controlling method may further comprise:

a step of acquiring a current reference section in which the rotation angle lies after stopping the forward driving control;

a step of starting measuring a section residence time in which the rotation angle lies in the reference section;

a step of acquiring a current section at present in which the rotation angle lies;

a step of judging whether or not the reference section and the current section are the same;

a step of, in a case where it is judged that the reference section and the current section are the same, judging whether or not the section residence time has reached a stop time; and a step of, in a case where it is judged that the section residence time has reached the stop time, judging that the engine has stopped rotating.

In the drive controlling method, wherein in a case where it is judged that the reference section and the current section are not the same, the drive controlling method may return to the step of acquisition of the current reference section in which the rotation angle lies.

In the drive controlling method, wherein in a case where it is judged that the section residence time has not reached the stop time, the drive controlling method may return to the step of acquisition of the current section at present in which the rotation angle lies.

In the drive controlling method, wherein in the case where the rotation angle has passed through the second top dead center, the sensor may output reference position signal.

In the drive controlling method, wherein the first correction amount may be the difference between a bottom dead center between the intake stroke and the compression stroke and the first top dead center.

In the drive controlling method, wherein the second correction amount may be the difference between a bottom dead center between the intake stroke and the compression stroke and the second top dead center.

A drive controlling method according to an embodiment of an aspect of the present invention is a drive controlling apparatus that controls driving of a four-stroke engine, comprising:

a storage part that stores a map used to control the engine;

an electric power controlling circuit that controls an operation of a motor that applies a torque to the engine; and a CPU that refers to the ROM and controls the electric power controlling circuit to control the motor based on a top dead center and a change of a rotation angle of the engine detected by a sensor, wherein the drive controlling apparatus performs:

a step of driving the engine in a forward direction by applying a reference torque that exceeds a first top dead center between an exhaust stroke and an intake stroke but does not exceed a second top dead center between a compression stroke and a combustion stroke to the engine in a forward driving control, and then, after the engine stops rotating, judging whether or not the rotation angle has passed through the first top dead center as a result of a forward movement of the engine based on whether a reference position signal that indicates that the rotation angle has passed through the first top dead center is output from the sensor;

a step of, in a case where it is judged that the rotation angle has passed through the first top dead center, judging whether or not an amount of forward movement of the engine driven in the forward direction is equal to or greater than an amount of reverse movement of the engine driven in a reverse direction based on a result of detection of the rotation angle by the sensor;

a step of, in a case where it is judged that the rotation angle has passed through the first top dead center, and the amount of forward movement is equal to or greater than the amount of reverse movement, judging that a current rotation angle of the engine lies in the intake stroke or the compression stroke and is positioned at a rotation angle shifted from the first top dead center by a difference between the amount of forward movement and the amount of reverse movement detected by the sensor;

a step of, in a case where it is judged that the rotation angle has passed through the first top dead center, and the amount of forward movement is not equal to or greater than the amount of reverse movement, judging that the current rotation angle of the engine lies in the combustion stroke or the exhaust stroke and is positioned at a rotation angle shifted from the first top dead center by the difference between the amount of forward movement and the amount of reverse movement detected by the sensor;

a step of, in a case where it is judged that the rotation angle has not passed through the first top dead center, judging whether or not the amount of forward movement of the engine driven in the forward direction is equal to or greater than the amount of reverse movement of the engine driven in the reverse direction based on a result of detection of the rotation angle by the sensor;

a step of, in a case where it is judged that the rotation angle has not passed through the first top dead center, and the amount of forward movement is equal to or greater than the amount of reverse movement, judging that the current rotation angle of the engine lies in the intake stroke or the compression stroke and is positioned at a rotation angle shifted from a rotation angle shifted from the first top dead center in the forward direction by a first correction amount by the difference between the amount of forward movement and the amount of reverse movement detected by the sensor; and a step of, in a case where it is judged that the rotation angle has not passed through the first top dead center, and the amount of forward movement is not equal to or greater than the amount of reverse movement, judging that the current rotation angle of the engine is positioned at a rotation angle shifted from the second top dead center in the reverse direction by a second correction amount by the difference between the amount of forward movement and the amount of reverse movement detected by the sensor.

In the drive controlling apparatus, wherein the drive controlling apparatus may be capable of modifying the first correction amount and the second correction amount.

According to a drive controlling method according to an aspect of the present invention, the engine is driven in the forward direction by a predetermined reference torque, and the position of the rotation angle of the engine driven in the forward direction is judged based on information concerning whether the rotation angle has passed through the first top dead center in the forward movement of the engine, the amount of forward movement of the engine driven in the forward direction and the amount of reverse movement of the engine driven in the reverse direction.

Therefore, the rotation angle of the engine can be judged even if there is no information on the rotation angle of the engine when the ECU is powered on.

That is, according to the drive controlling method according to the aspect of the present invention, when the ECU is powered on, the stroke of the engine can be identified before a motor starting control occurs.

BEST MODE FOR CARRYING OUT THE INVENTION

In the following, an embodiment of the present invention will be described with reference to the drawings.

Embodiment 1

Figure 1:
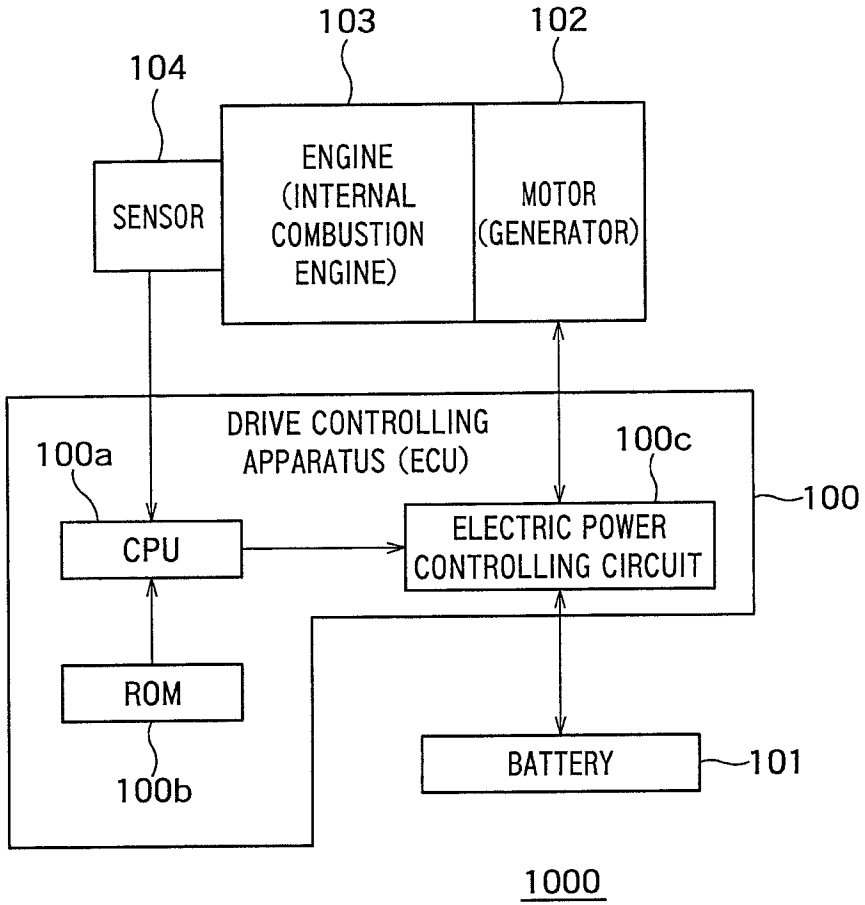
FIG. 1 is a diagram showing an example of a configuration of a drive controlling system 1000 according to an embodiment 1, which is an aspect of the present invention.
Figure 2:
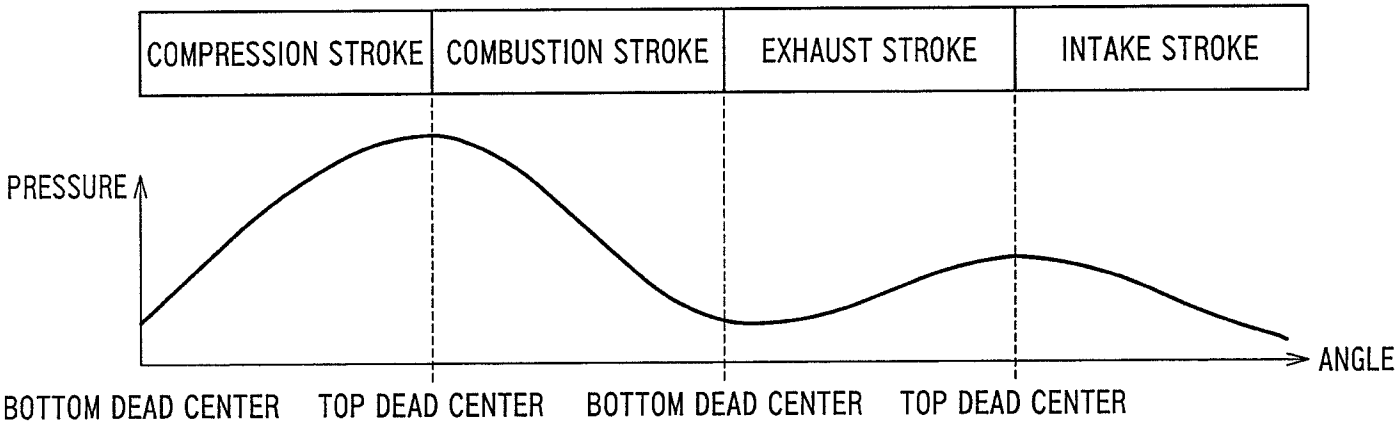
FIG. 2 is a diagram showing an example of a relationship between each stroke (a crank angle) of an engine 103 of the drive controlling system 1000 shown in FIG. 1 and the pressure in a cylinder.

FIG. 1 is a diagram showing an example of a configuration of a drive controlling system 1000 according to an embodiment 1, which is an aspect of the present invention. FIG. 2 is a diagram showing an example of a relationship between each stroke (a crank angle) of an engine 103 of the drive controlling system 1000 shown in FIG. 1 and the pressure in a cylinder.

As shown in FIG. 1, the drive controlling system 1000 that controls driving of the engine includes a drive controlling apparatus (an engine control unit (ECU)) 100, a battery 101, a motor 102, an engine (an internal combustion engine) 103 and a sensor 104.

The engine 103 is a four-stroke engine, for example. Therefore, as shown in FIG. 2, the state of the engine 103 transits through an intake stroke, a compression stroke, a combustion stroke and an exhaust stroke. In addition, as shown in FIG. 2, the pressure in the cylinder of the engine 103 (that is, the resistance to the rotation of the crank) reaches a maximum at a top dead center.

The motor 102 is configured to apply a torque to a crank shaft of the engine 103. In this example, the motor 102 is coupled to the crank shaft of the engine 103 in such a manner that the motor 102 can apply a torque to and receive a torque from the crank shaft. That is, the motor 102 functions as both a electric motor and a generator.

The sensor 104 is configured to detect the rotation number and the crank angle (a change of the rotation angle or a top dead center, for example) of the engine 103 and output a detection signal responsive to the result of the detection.

In particular, the sensor 104 is configured to output a reference position signal as one detection signal if the rotation angle passes through a first top dead center (a reference position) between the exhaust stroke and the intake stroke and through a second top dead center between the compression stroke and the combustion stroke.

The battery 101 is configured to supply a driving electric power to the motor 102 or be charged with an electric power regenerated by the motor 102.

The drive controlling apparatus 100 is configured to control driving of the engine 103 by judging the state of the engine 103 based on the detection signal (that is, the rotation number and the crank angle (a change of the rotation angle or the top dead center, for example) of the engine 103 obtained from the detection signal).

The drive controlling apparatus 100 has a central processing unit (CPU) 100*a*, a read only memory (ROM) 100*b* serving as a storage part and an electric power controlling circuit 100*c*, for example.

The electric power controlling circuit 100*c* is configured to control the operation of the motor 102 that applies a torque to the engine 103.

The ROM 100*b* is configured to store a map for controlling start or other operation of the engine 103 (i.e., for controlling the motor 102).

The CPU 100*a* is configured to refer to the ROM 100*b* and control the electric power controlling circuit 100*c* to control the motor 102 based on the rotation number and the crank angle (a change of the rotation angle or the top dead center, for example) of the engine 103 detected by the sensor 101.

Next, there will be described an example of a drive controlling method for the drive controlling apparatus 100 of the drive controlling system 1000 configured as described above to control driving of a four-stroke engine based on a signal output from a sensor that detects a change of the rotation angle and a top dead center of the four-stroke engine.

Figure 3:
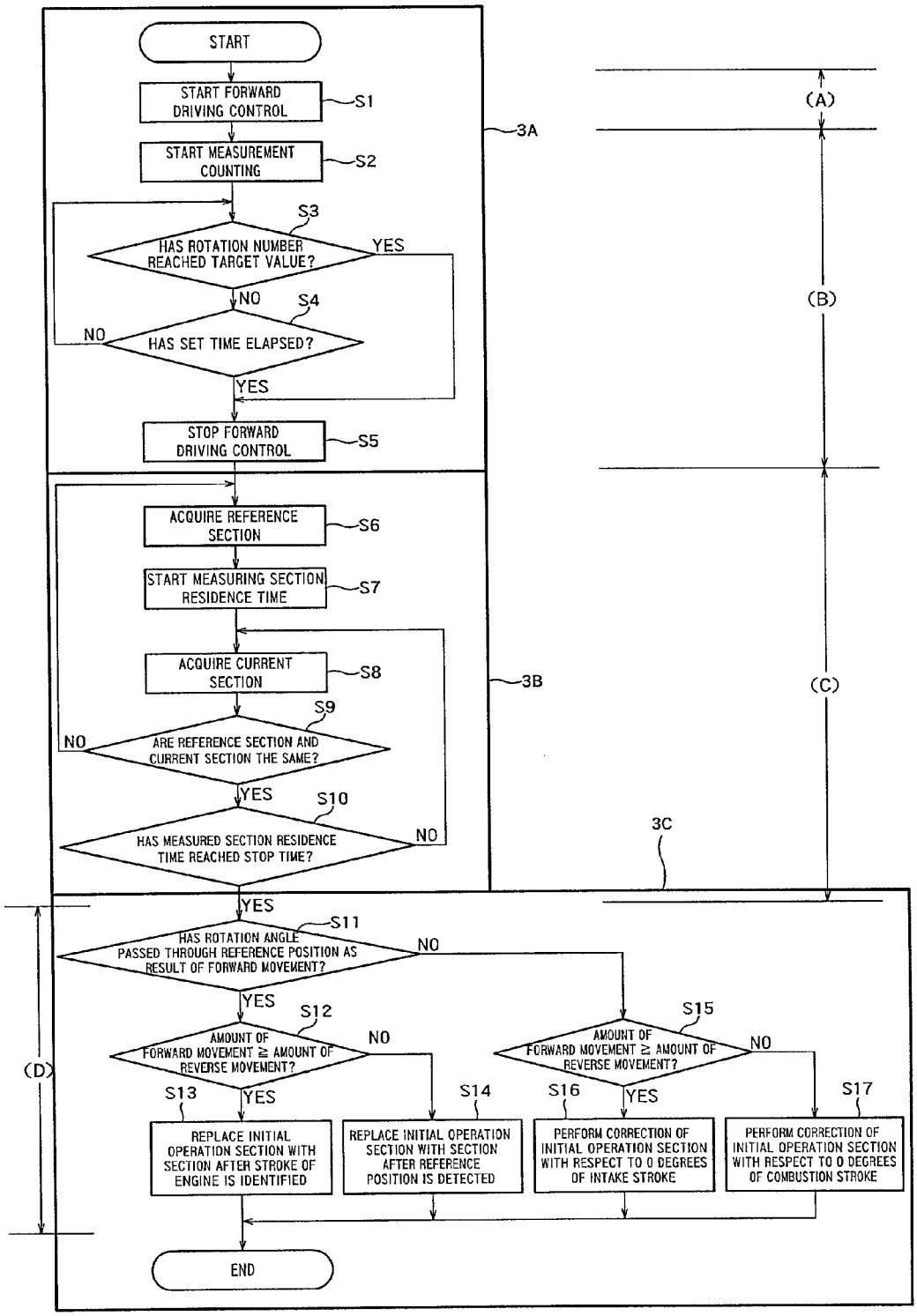
FIG. 3 is a flowchart showing an example of the drive controlling method according to the embodiment 1 performed by the drive controlling apparatus 100 shown in FIG. 1.
Figure 3A:
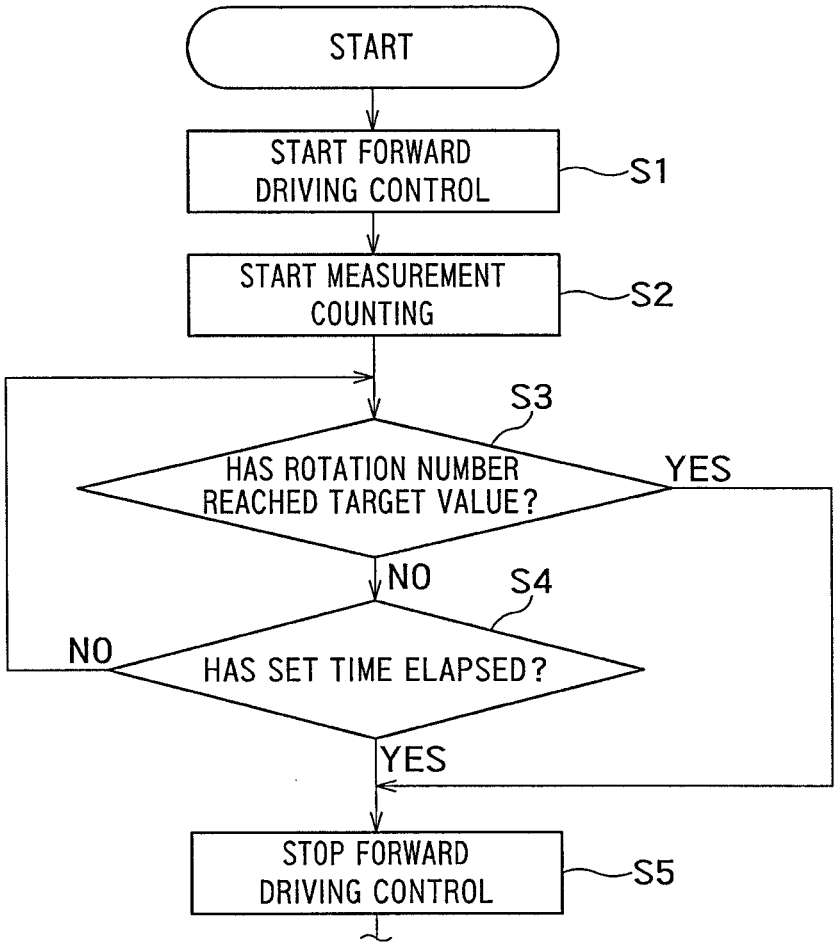
Figure 3B:
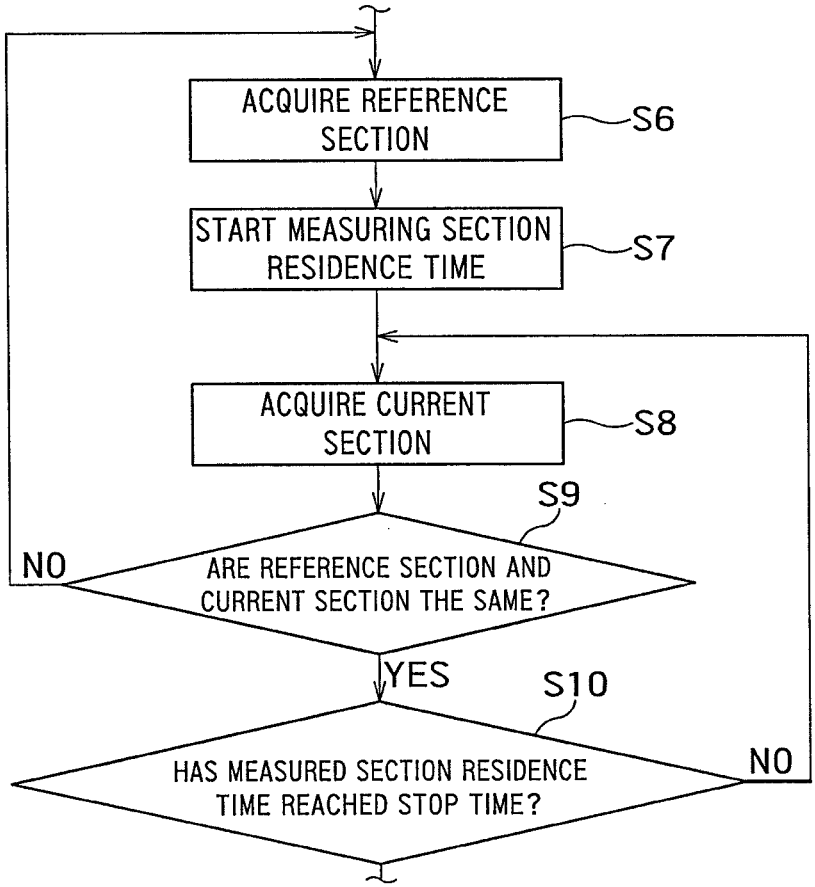
Figure 3C:
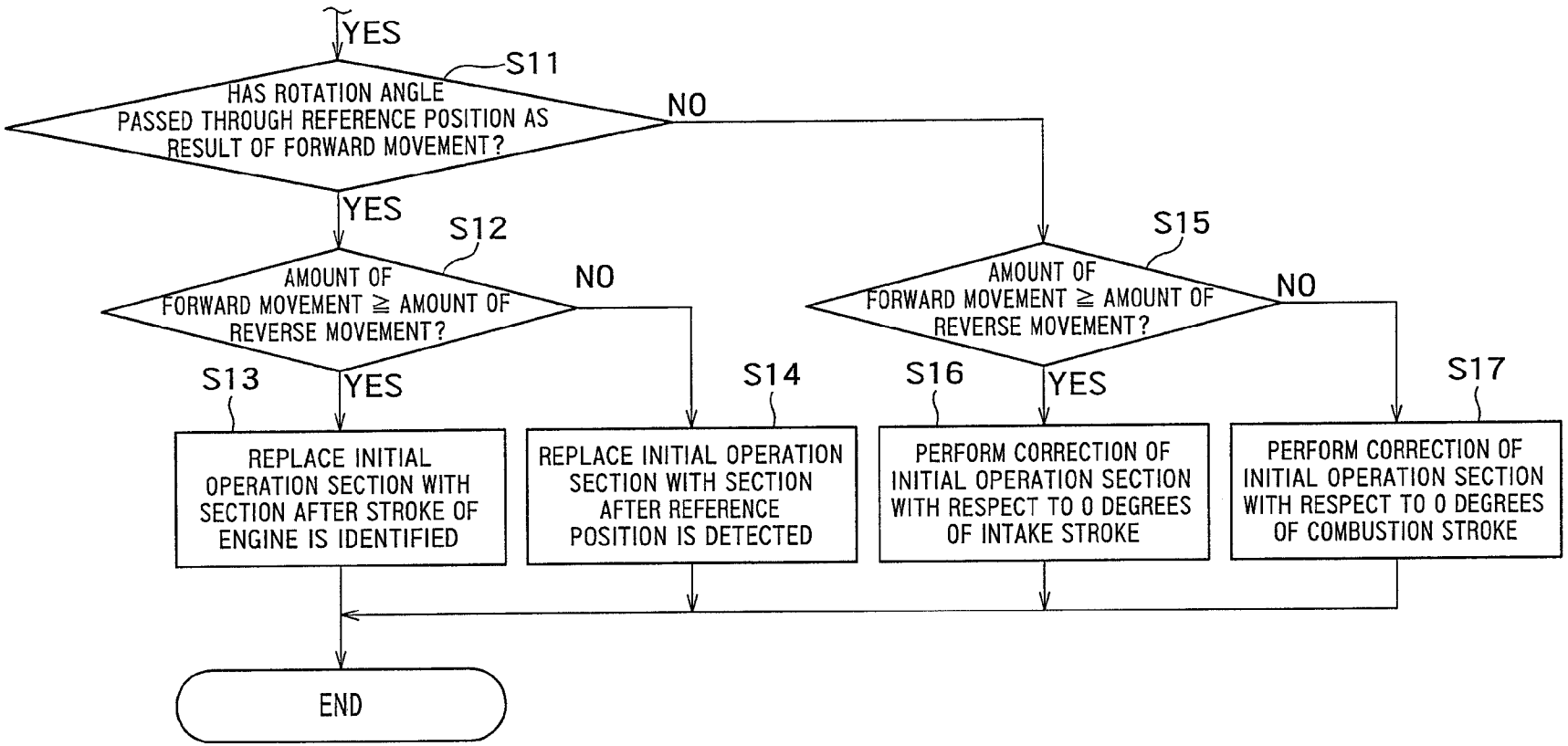

FIG. 3 is a flowchart showing an example of the drive controlling method according to the embodiment 1 performed by the drive controlling apparatus 100 shown in FIG. 1. That is, the drive controlling apparatus 100 performs the following steps.

As shown in FIG. 3, first, the drive controlling apparatus 100 starts a forward driving control and makes the motor 102 a rotating shaft of which is connected to the crank shaft of the engine 103 start applying a torque to the engine 103 (step S1).

Then, the drive controlling apparatus 100 starts measurement counting of a torque application time from the start of application of the torque to the engine 103 (step S2).

Then, the drive controlling apparatus 100 judges whether or not the rotation number of the engine 103 detected by the sensor 104 has reached a target value (step S3).

If the drive controlling apparatus 100 judges in the step S3 that the rotation number of the engine 103 has not reached the target value the drive controlling apparatus 100 judges whether or not the torque application time has reached a set time (step S4).

If the drive controlling apparatus 100 judges in the step S4 that the torque application time has not reached the set time, the drive controlling apparatus 100 returns to the step S3, in which the drive controlling apparatus 100 judges whether or not the rotation number of the engine 103 detected by the sensor 104 has reached the target value.

In this way, a reference torque that exceeds the first top dead center between the exhaust stroke and the intake stroke but does not exceeds the second top dead center between the compression stroke and the combustion stroke is applied to the engine 103 in the forward driving control, thereby driving the engine 103 in a forward direction.

On the other hand, if the drive controlling apparatus 100 judges in the step S3 that the rotation number of the engine 103 has reached the target value or judges in the step S4 that the torque application time has reached the set time, the drive controlling apparatus 100 judges that the reference torque is applied to the engine 103, and stops the forward driving control to stop the application of the torque from the motor 102 to the engine 103 (step S5).

After stopping the forward driving control, the drive controlling apparatus 100 acquires a current reference section in which the rotation angle lies (step S6).

Then, the drive controlling apparatus 100 starts measuring a section residence time in which the rotation angle lies in the reference section (step S7).

Then, the drive controlling apparatus 100 acquires a current section at present in which the rotation angle lies (step S8).

Then, the drive controlling apparatus 100 judges whether or not the reference section and the current section are the same (step S9).

If the drive controlling apparatus 100 judges in the step S9 that the reference section and the current section are not the same, the drive controlling apparatus 100 returns to the step S6, in which the drive controlling apparatus 100 acquires the current reference section in which the rotation angle lies.

On the other hand, if the drive controlling apparatus 100 judges in the step S9 that the reference section and the current section are the same, the drive controlling apparatus 100 judges whether or not the section residence time has reached a stop time (step S10).

If the drive controlling apparatus 100 judges in the step S10 that the section residence time has reached the stop time, the drive controlling apparatus 100 judges that the engine 103 has stopped rotating.

On the other hand, if the drive controlling apparatus 100 judges that the section residence time has not reached the stop time, the drive controlling apparatus 100 returns to the step S8, in which the drive controlling apparatus 100 acquires the current section at present in which the rotation angle lies.

Then, after the engine 103 has stopped rotating, the drive controlling apparatus 100 judges whether or not the rotation angle has passed through the first top dead center as a result of the forward movement of the engine 103 based on whether or not the sensor 104 has output the reference position signal that indicates that the rotation angle has passed through the first top dead center (step S11).

Then, if the drive controlling apparatus 100 judges in the step S11 that the rotation angle has passed through the first top dead center, the drive controlling apparatus 100 judges whether or not the amount of forward movement of the engine 103 driven in the forward direction is equal to or greater than the amount of reverse movement of the engine 103 driven in a reverse direction based on the result of detection of the rotation angle by the sensor 104 (step S12).

If the drive controlling apparatus 100 judges in the step S11 that the rotation angle has passed through the first top dead center and judges in the step S12 that the amount of forward movement is equal to or greater than the amount of reverse movement, the drive controlling apparatus 100 judges that the current rotation angle of the engine 103 lies in the intake stroke or the compression stroke and is positioned at a rotation angle shifted from the first top dead center by the difference between the amount of forward movement and the amount of reverse movement detected by the sensor 104 (step S13).

That is, an initial operation section of the engine is replaced with the section after the stroke of the engine is identified which is judged in the step S13.

If the drive controlling apparatus 100 judges in the step S11 that the rotation angle has passed through the first top dead center and judges in the step S12 that the amount of forward movement is not equal to or greater than the amount of reverse movement, the drive controlling apparatus 100 judges that the current rotation angle of the engine 103 lies in the combustion stroke or the exhaust stroke and is positioned at a rotation angle shifted from the first top dead center by the difference between the amount of forward movement and the amount of reverse movement detected by the sensor 104 (step S14).

That is, the initial operation section of the engine is replaced with the section after the reference position is detected which is judged in the step S14.

On the other hand, if the drive controlling apparatus 100 judges in the step S11 that the rotation angle has not passed through the first top dead center, the drive controlling apparatus 100 judges whether or not the amount of forward movement of the engine 103 driven in the forward direction is equal to or greater than the amount of reverse movement of the engine 103 driven in the reverse direction based on the result of detection of the rotation angle by the sensor 104 (step S15).

If the drive controlling apparatus 100 judges in the step S11 that the rotation angle has not passed through the first top dead center and judges in the step S15 that the amount of forward movement is equal to or greater than the amount of reverse movement, the drive controlling apparatus 100 judges that the current rotation angle of the engine 103 lies in the intake stroke or the compression stroke and is positioned at a rotation angle shifted from the rotation angle shifted from the first top dead center in the forward direction by a first correction amount by the difference between the amount of forward movement and the amount of reverse movement detected by the sensor 104 (step S16).

That is, the initial operation section of the engine is corrected with respect to 0 degrees in the intake stroke.

If the drive controlling apparatus 100 judges in the step S11 that the rotation angle has not passed through the first top dead center and judges in the step S15 that the amount of forward movement is not equal to or greater than the amount of reverse movement, the drive controlling apparatus 100 judges that the current rotation angle of the engine 103 is positioned at a rotation angle shifted from a rotation angle shifted from the second top dead center in the reverse direction by a second correction amount by the difference between the amount of forward movement and the amount of reverse movement detected by the sensor 104 (step S17).

That is, the initial operation section of the engine is corrected with respect to 0 degrees in the combustion stroke.

The first correction amount is the difference between a bottom dead center between the intake stroke and the compression stroke and the first top dead center. The second correction amount is the difference between the bottom dead center between the intake stroke and the compression stroke and the second top dead center.

The drive controlling apparatus 100 can modify the first correction amount and the second correction amount. Therefore, the drive controlling apparatus 100 can appropriately modify the first correction amount and the second correction amount depending on the movement of the engine 103.

As described above, the drive controlling apparatus 100 judges where the current rotation angle of the engine 103 lies through the steps S13, S14, S16 and S17, and ends the flow.

Next, a specific example in which the position of the rotation angle is judged in the drive controlling method described above will be described.

Figure 4:
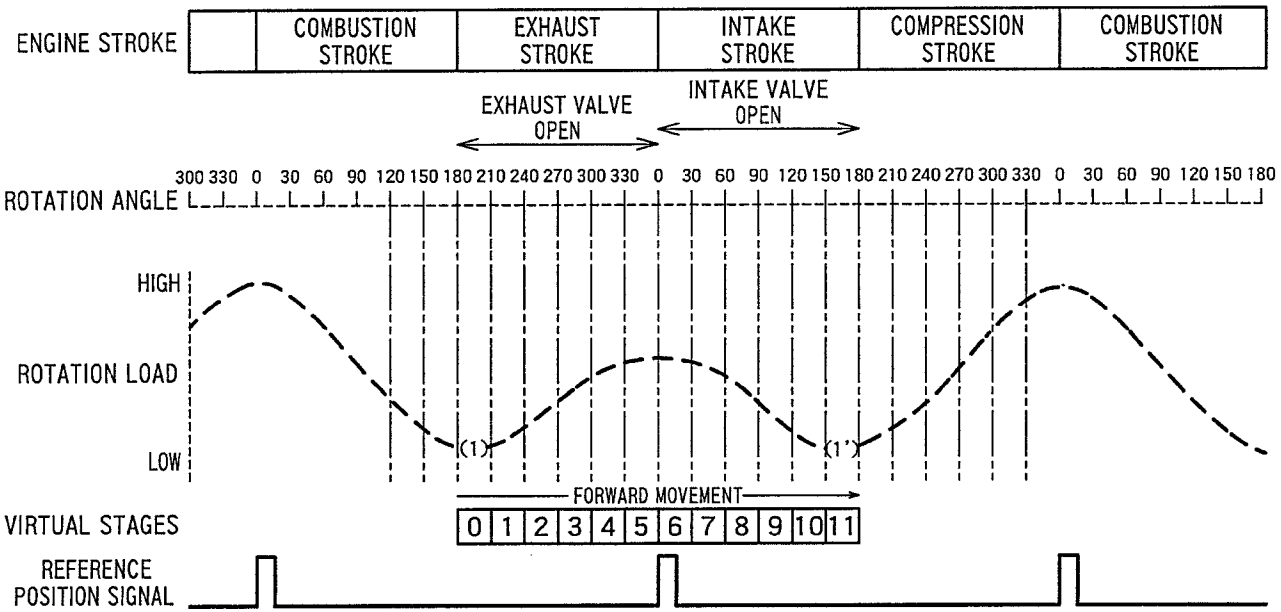
FIG. 4 is a diagram showing an example of a relationship among the engine strokes, the rotation angle, the rotation load, virtual stages corresponding to the rotation angle and the reference position signal in the case where the rotation angle has passed through the reference position in the forward movement, and the amount of forward movement is equal to or greater than the amount of reverse movement.
Figure 5:
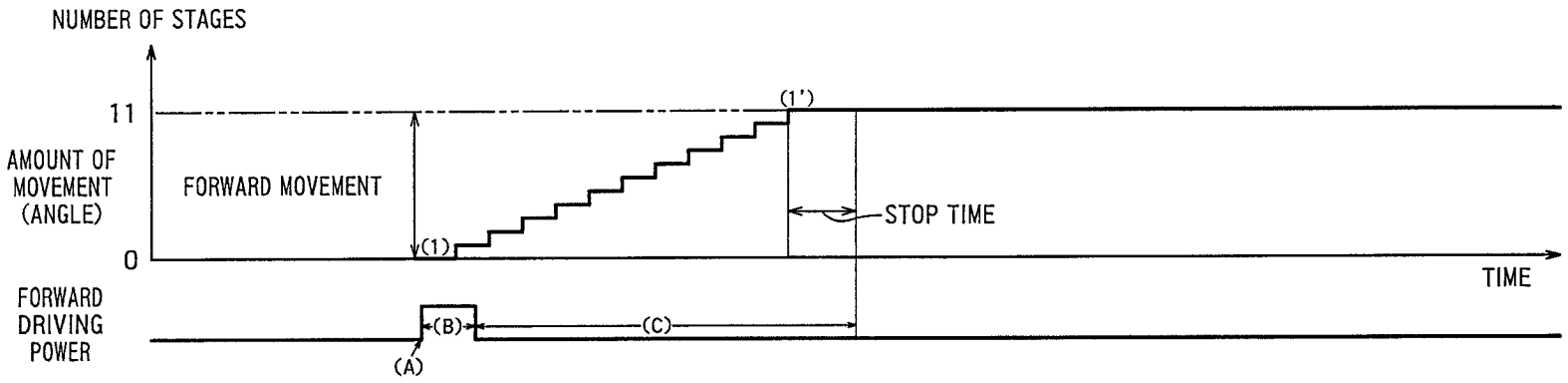
FIG. 5 is a diagram showing a relationship between the amount of movement and a forward driving power in the case shown in FIG. 4.

FIG. 4 is a diagram showing an example of a relationship among the engine strokes, the rotation angle, the rotation load, virtual stages corresponding to the rotation angle and the reference position signal in the case where the rotation angle has passed through the reference position in the forward movement, and the amount of forward movement is equal to or greater than the amount of reverse movement. FIG. 5 is a diagram showing a relationship between the amount of movement and a forward driving power in the case shown in FIG. 4.

Figure 6:
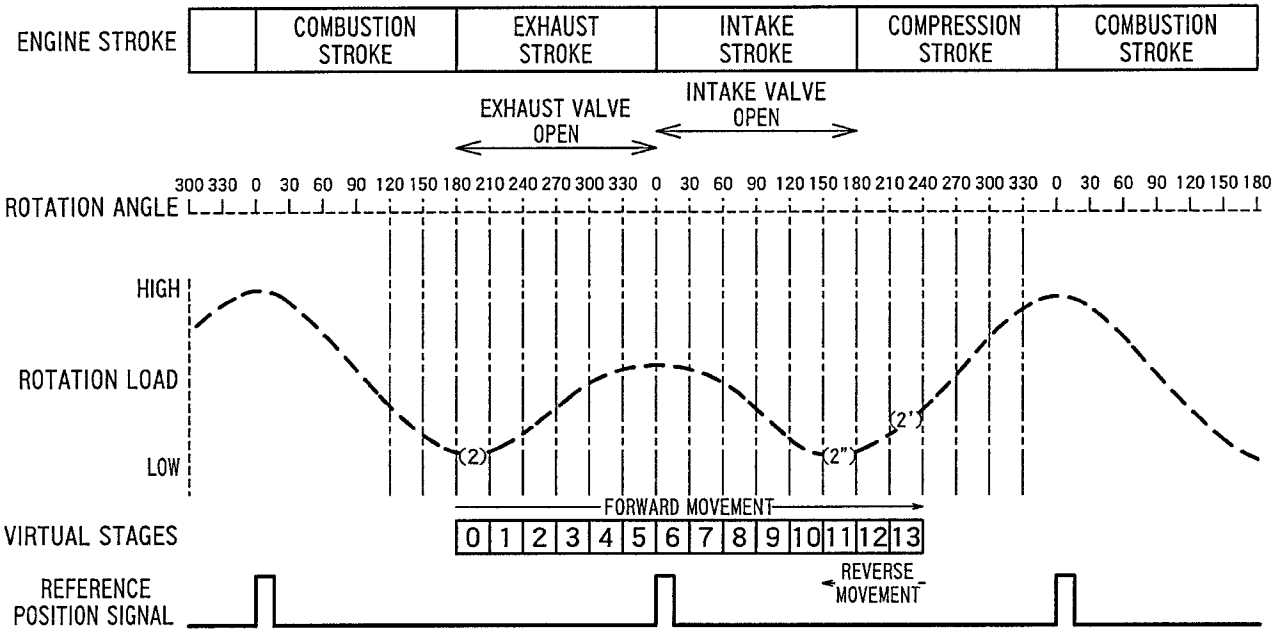
FIG. 6 is a diagram showing another example of the relationship among the engine strokes, the rotation angle, the rotation load, the virtual stages corresponding to the rotation angle and the reference position signal in the case where the rotation angle has passed through the reference position in the forward movement, and the amount of forward movement is equal to or greater than the amount of reverse movement.
Figure 7:
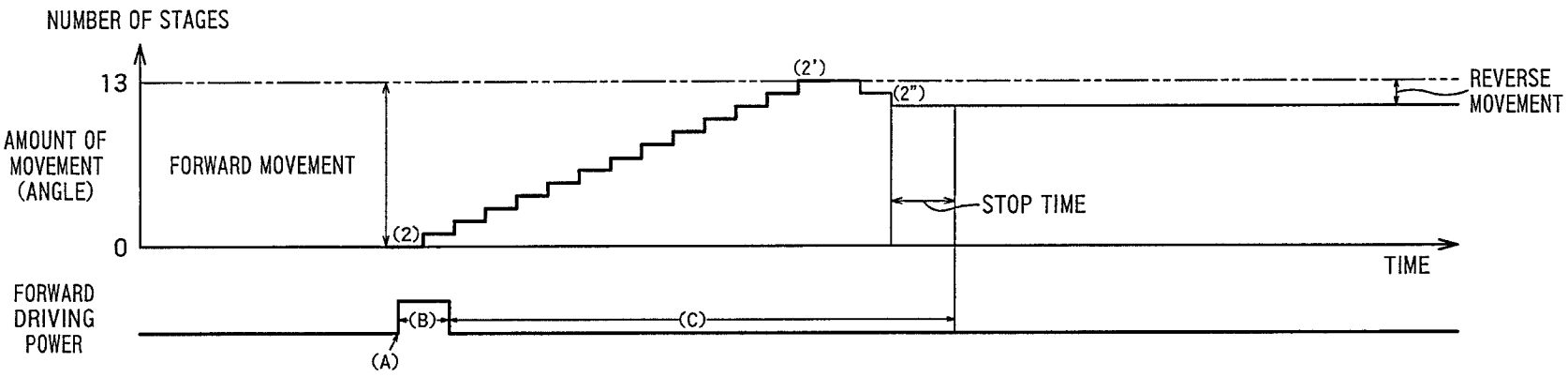
FIG. 7 is a diagram showing a relationship between the amount of movement and the forward driving power in the case shown in FIG. 6.

FIG. 6 is a diagram showing another example of the relationship among the engine strokes, the rotation angle, the rotation load, the virtual stages corresponding to the rotation angle and the reference position signal in the case where the rotation angle has passed through the reference position in the forward movement, and the amount of forward movement is equal to or greater than the amount of reverse movement. FIG. 7 is a diagram showing a relationship between the amount of movement and the forward driving power in the case shown in FIG. 6.

Figure 8:
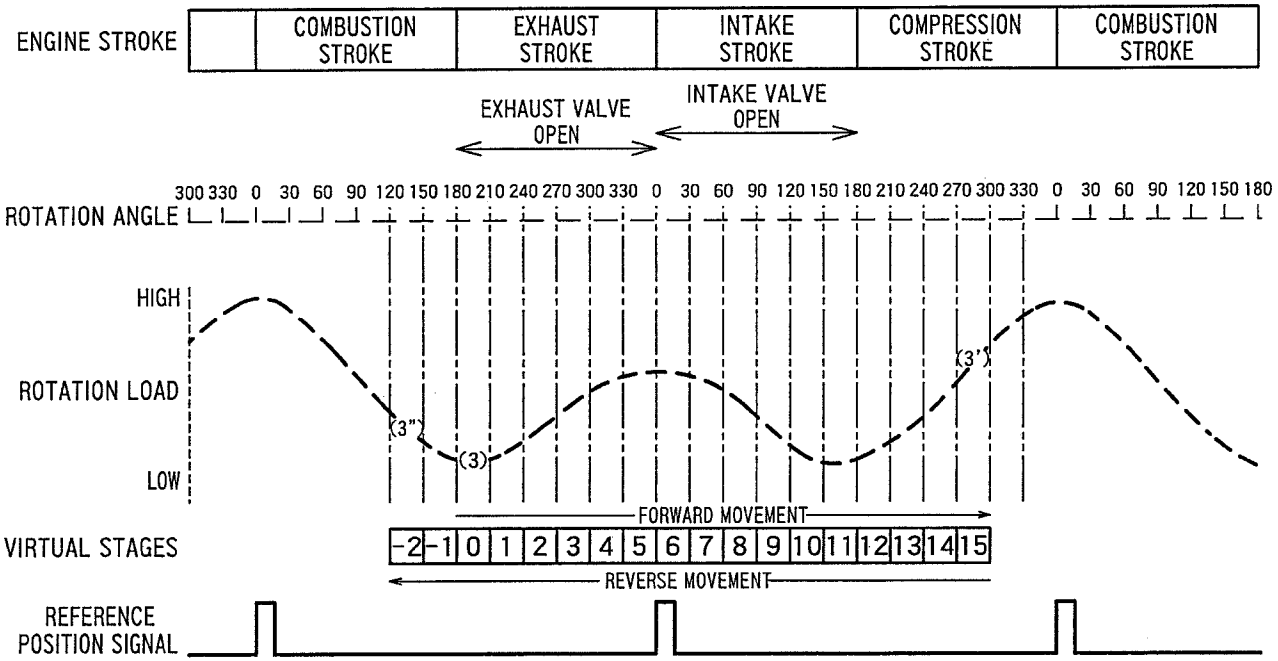
FIG. 8 is a diagram showing an example of a relationship among the engine strokes, the rotation angle, the rotation load, the virtual stages corresponding to the rotation angle and the reference position signal in the case where the rotation angle has passed through the reference position in the forward movement, and the amount of forward movement is smaller than the amount of reverse movement.
Figure 9:
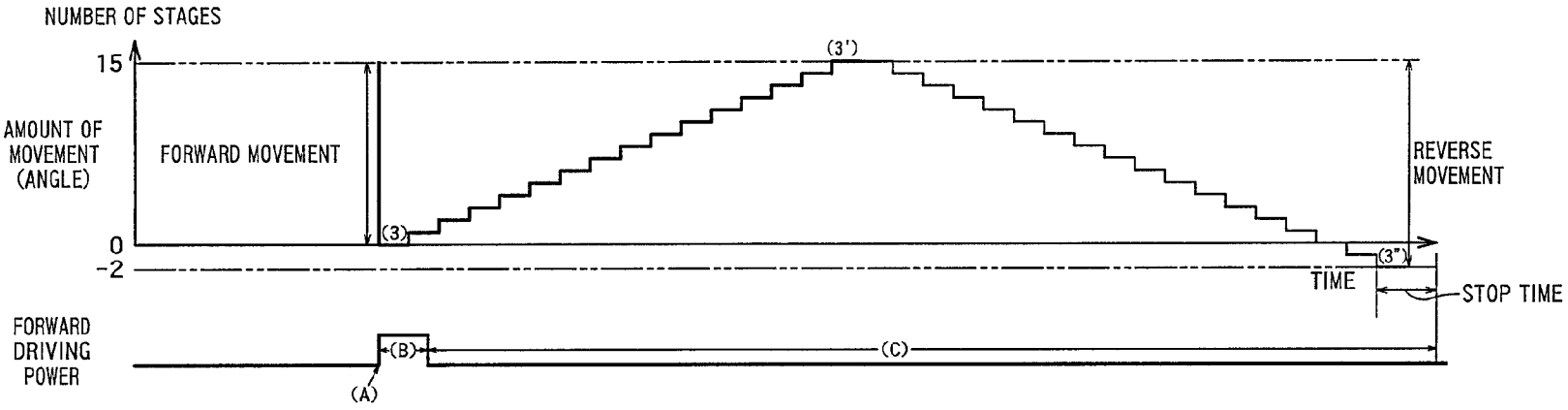
FIG. 9 is a diagram showing a relationship between the amount of movement and the forward driving power in the case shown in FIG. 8.

FIG. 8 is a diagram showing an example of a relationship among the engine strokes, the rotation angle, the rotation load, the virtual stages corresponding to the rotation angle and the reference position signal in the case where the rotation angle has passed through the reference position in the forward movement, and the amount of forward movement is smaller than the amount of reverse movement. FIG. 9 is a diagram showing a relationship between the amount of movement and the forward driving power in the case shown in FIG. 8.

Figure 10:
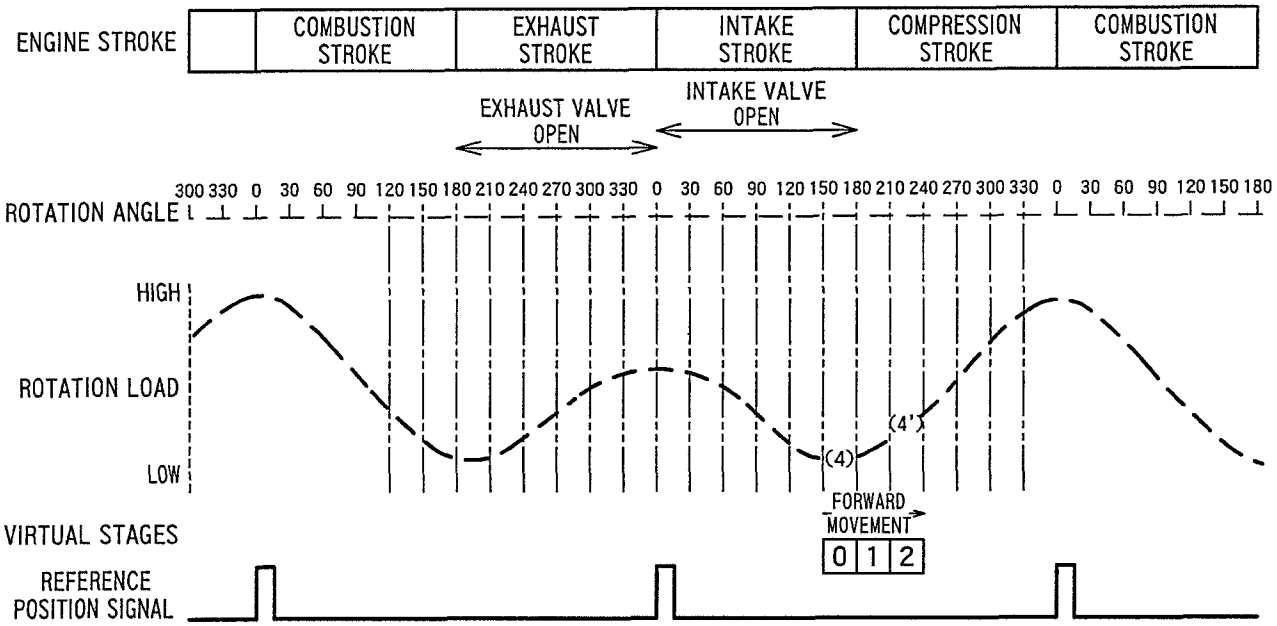
FIG. 10 is a diagram showing an example of a relationship among the engine strokes, the rotation angle, the rotation load, the virtual stages corresponding to the rotation angle and the reference position signal in the case where the rotation angle has not passed through the reference position in the forward movement, and the amount of forward movement is equal to or greater than the amount of reverse movement.
Figure 11:
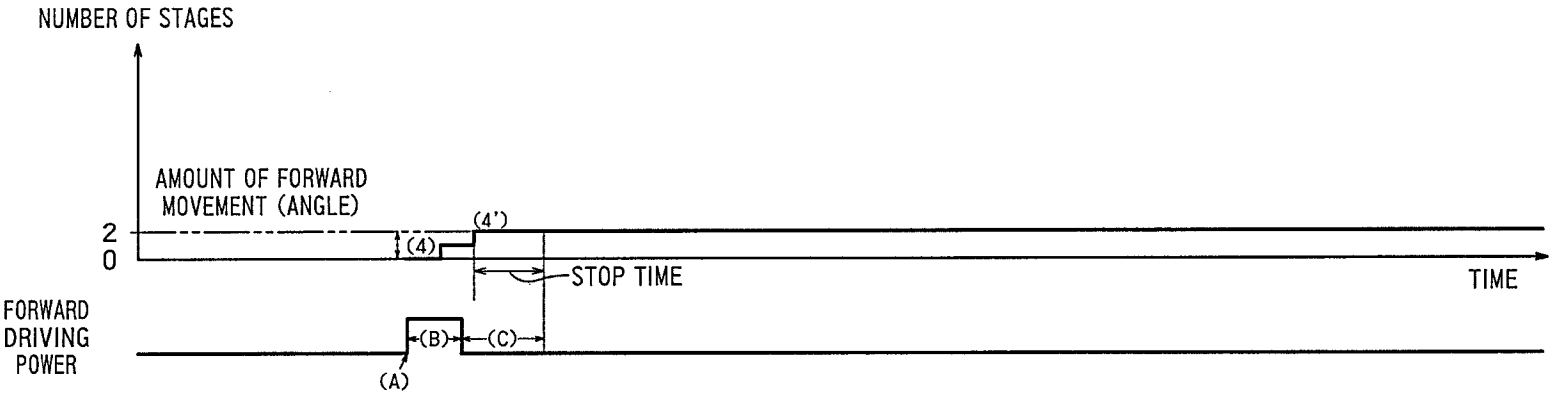
FIG. 11 is a diagram showing a relationship between the amount of movement and the forward driving power in the case shown in FIG. 10.

FIG. 10 is a diagram showing an example of a relationship among the engine strokes, the rotation angle, the rotation load, the virtual stages corresponding to the rotation angle and the reference position signal in the case where the rotation angle has not passed through the reference position in the forward movement, and the amount of forward movement is equal to or greater than the amount of reverse movement. FIG. 11 is a diagram showing a relationship between the amount of movement and the forward driving power in the case shown in FIG. 10.

Figure 12:
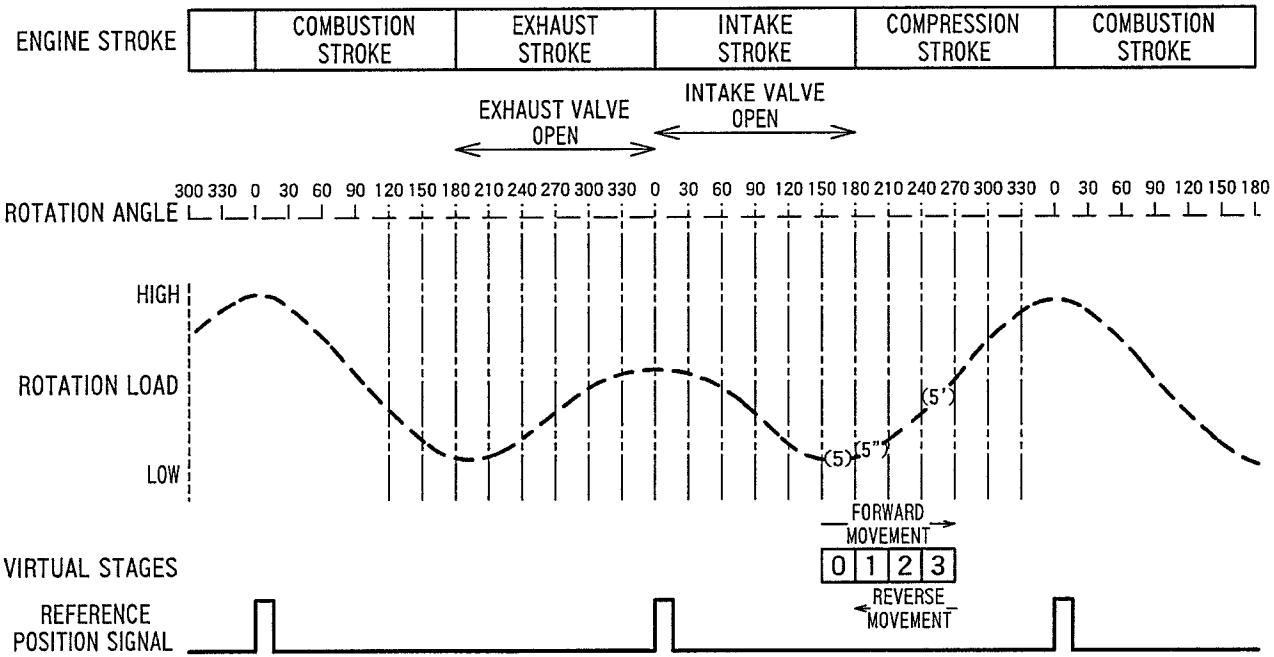
FIG. 12 is a diagram showing another example of the relationship among the engine strokes, the rotation angle, the rotation load, the virtual stages corresponding to the rotation angle and the reference position signal in the case where the rotation angle has not passed through the reference position in the forward movement, and the amount of forward movement is equal to or greater than the amount of reverse movement.
Figure 13:
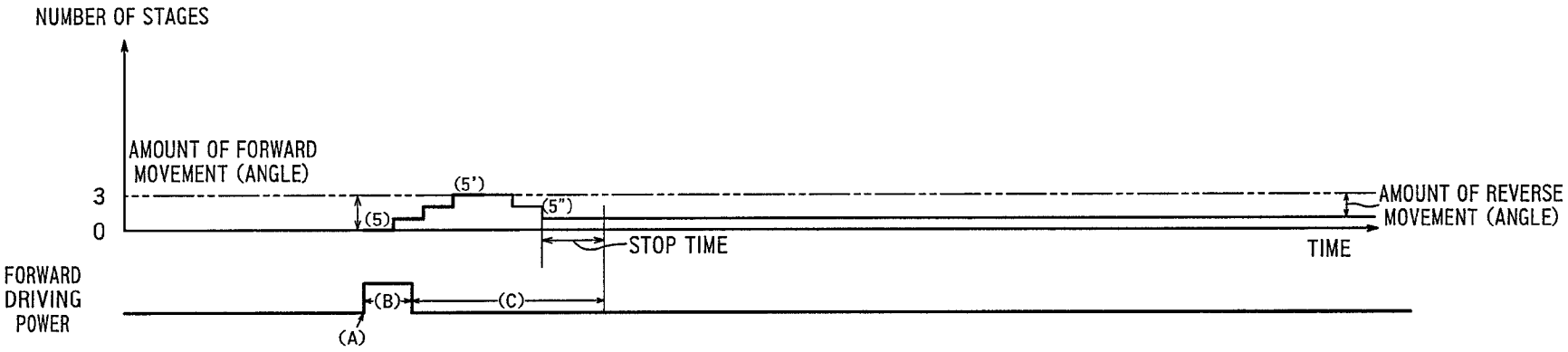
FIG. 13 is a diagram showing a relationship between the amount of movement and the forward driving power in the case shown in FIG. 12.

FIG. 12 is a diagram showing another example of the relationship among the engine strokes, the rotation angle, the rotation load, the virtual stages corresponding to the rotation angle and the reference position signal in the case where the rotation angle has not passed through the reference position in the forward movement, and the amount of forward movement is equal to or greater than the amount of reverse movement. FIG. 13 is a diagram showing a relationship between the amount of movement and the forward driving power in the case shown in FIG. 12.

Figure 14:
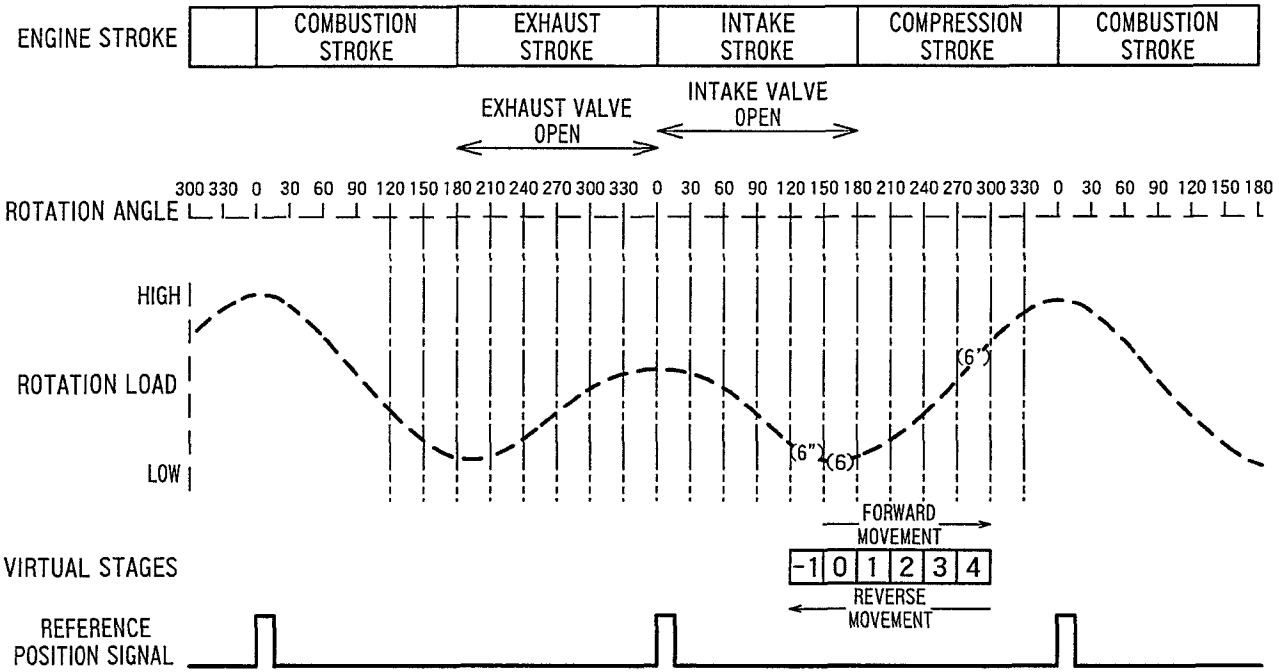
FIG. 14 is a diagram showing an example of a relationship among the engine strokes, the rotation angle, the rotation load, the virtual stages corresponding to the rotation angle and the reference position signal in the case where the rotation angle has not passed through the reference position in the forward movement, and the amount of forward movement is smaller than the amount of reverse movement.
Figure 15:
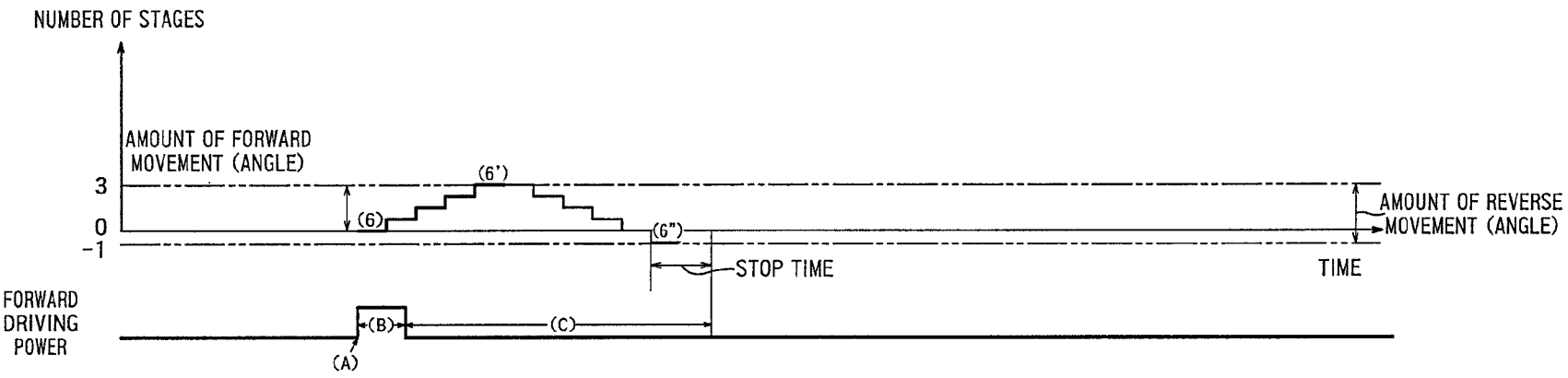
FIG. 15 is a diagram showing a relationship between the amount of movement and the forward driving power in the case shown in FIG. 14.

FIG. 14 is a diagram showing an example of a relationship among the engine strokes, the rotation angle, the rotation load, the virtual stages corresponding to the rotation angle and the reference position signal in the case where the rotation angle has not passed through the reference position in the forward movement, and the amount of forward movement is smaller than the amount of reverse movement. FIG. 15 is a diagram showing a relationship between the amount of movement and the forward driving power in the case shown in FIG. 14.

A stroke (A) in FIGS. 5, 7, 9, 11, 13 and 15 corresponds to the step S1 in FIG. 3. A stroke (B) in FIGS. 5, 7, 9, 11, 13 and 15 corresponds to the steps S2, S3, S4 and S5 in FIG. 3. A stroke (C) in FIGS. 5, 7, 9, 11, 13 and 15 corresponds to the steps S6, S7, S8, S9 and S10 in FIG. 3.

In each diagram, one virtual stage corresponds to a rotation angle of 30 degrees. However, the rotation angle corresponding to one virtual stage is not limited to 30 degrees but may be other angles, such as 10 degrees or 15 degrees.

As an example, in the case shown in FIGS. 4 and 5, the rotation angle of the engine 103 moves in the forward direction from a stage (1), which is the initial position, to a stage (1'). In addition, the sensor 104 outputs the reference position signal.

In this case, the drive controlling apparatus 100 judges in the step S11 described above that the rotation angle has passed through the first top dead center and judges in the step S12 that the amount of forward movement is equal to or greater than the amount of reverse movement. That is, as shown in the step S13 described above, the drive controlling apparatus 100 judges that the current rotation angle of the engine 103 lies in the intake stroke or the compression stroke and is positioned at a rotation angle shifted from the first top dead center by the difference between the amount of forward movement and the amount of reverse movement detected by the sensor 104.

As another example, in the case shown in FIGS. 6 and 7, the rotation angle of the engine 103 moves in the forward direction from a stage (2), which is the initial position, to a stage (2') and moves in the reverse direction from the stage (2') to a stage (2"). In addition, the sensor 104 outputs the reference position signal.

In this case, the drive controlling apparatus 100 judges in the step S11 described above that the rotation angle has passed through the first top dead center and judges in the step S12 that the amount of forward movement is equal to or greater than the amount of reverse movement. That is, as shown in the step S13 described above, the drive controlling apparatus 100 judges that the current rotation angle of the engine 103 lies in the intake stroke or the compression stroke and is positioned at a rotation angle shifted from the first top dead center by the difference between the amount of forward movement and the amount of reverse movement detected by the sensor 104.

As another example, in the case shown in FIGS. 8 and 9, the rotation angle of the engine 103 moves in the forward direction from a stage (3), which is the initial position, to a stage (3') and moves in the reverse direction from the stage (3') to a stage (3"). In addition, the sensor 104 outputs the reference position signal.

In this case, the drive controlling apparatus 100 judges in the step S11 described above that the rotation angle has passed through the first top dead center and judges in the step S12 that the amount of forward movement is not equal to or greater than the amount of reverse movement. That is, as shown in the step S14 described above, the drive controlling apparatus 100 judges that the current rotation angle of the engine 103 lies in the combustion stroke or the exhaust stroke and is positioned at a rotation angle shifted from the first top dead center by the difference between the amount of forward movement and the amount of reverse movement detected by the sensor 104.

As another example, in the case shown in FIGS. 10 and 11, the rotation angle of the engine 103 moves in the forward direction from a stage (4), which is the initial position, to a stage (4'). In addition, the sensor 104 does not output the reference position signal.

In this case, the drive controlling apparatus 100 judges in the step S11 described above that the rotation angle has not passed through the first top dead center and judges in the step S15 that the amount of forward movement is equal to or greater than the amount of reverse movement. That is, as shown in the step S16 described above, the drive controlling apparatus 100 judges that the current rotation angle of the engine 103 lies in the intake stroke or the compression stroke and is positioned at a rotation angle shifted from a rotation angle shifted from the first top dead center in the forward direction by the first correction amount by the difference between the amount of forward movement and the amount of reverse movement detected by the sensor 104.

As another example, in the case shown in FIGS. 12 and 13, the rotation angle of the engine 103 moves in the forward direction from a stage (5), which is the initial position, to a stage (5') and moves in the reverse direction from the stage (5') to a stage (5"). In addition, the sensor 104 does not output the reference position signal.

In this case, the drive controlling apparatus 100 judges in the step S11 described above that the rotation angle has not passed through the first top dead center and judges in the step S15 that the amount of forward movement is equal to or greater than the amount of reverse movement. That is, as shown in the step S16 described above, the drive controlling apparatus 100 judges that the current rotation angle of the engine 103 lies in the intake stroke or the compression stroke and is positioned at a rotation angle shifted from a rotation angle shifted from the first top dead center in the forward direction by the first correction amount by the difference between the amount of forward movement and the amount of reverse movement detected by the sensor 104.

As another example, in the case shown in FIGS. 14 and 15, the rotation angle of the engine 103 moves in the forward direction from a stage (6), which is the initial position, to a stage (6') and moves in the reverse direction from the stage (6') to a stage (6"). In addition, the sensor 104 does not output the reference position signal.

In this case, the drive controlling apparatus 100 judges in the step S11 described above that the rotation angle has not passed through the first top dead center and judges in the step S15 that the amount of forward movement is not equal to or greater than the amount of reverse movement. That is, in the step S17 described above, the drive controlling apparatus 100 judges that the current rotation angle of the engine 103 is positioned at a rotation angle shifted from a rotation angle shifted from the second top dead center in the reverse direction by the second correction amount by the difference between the amount of forward movement and the amount of reverse movement detected by the sensor 104.

As described above, according to the drive controlling method performed by the drive controlling apparatus 100, the engine is driven in the forward direction by a predetermined reference torque, and the position of the rotation angle of the engine driven in the forward direction is judged based on information concerning whether the rotation angle has passed through the first top dead center in the forward movement of the engine, the amount of forward movement of the engine driven in the forward direction and the amount of reverse movement of the engine driven in the reverse direction.

Therefore, the rotation angle of the engine can be judged even if there is no information on the rotation angle of the engine when the ECU is powered on.

That is, according to the drive controlling method according to an aspect of the present invention, when the ECU is powered on, the stroke of the engine can be identified before a motor starting control occurs.

It is to be noted that, although FIG. 1 shows the engine 103 and the motor 102 integrated with each other, the engine 103 and the motor 102 can be separate units.

The embodiment described above shows cases where the motor 102 functions as both a electric motor and a generator.

However, even if the motor 102 is coupled to the crank shaft of the engine 103 so as to apply a torque thereto and functions only as a motor, the effects and advantages of the present invention can be achieved. In that case, another motor that functions as a generator is additionally provided.

The embodiment described above is given for illustrative purposes, and the scope of the present invention is not limited thereto.

The invention claimed is:

1. A drive controlling method of controlling driving of a four-stroke engine based on a signal output from a sensor that detects a change of a rotation angle and a top dead center of the engine, comprising:

driving the engine in a forward direction by applying a reference torque that exceeds a first top dead center between an exhaust stroke and an intake stroke but does not exceed a second top dead center between a compression stroke and a combustion stroke to the engine in a forward driving control, and then, after the engine stops rotating, determining whether or not the rotation angle has passed through the first top dead center as a result of a forward movement of the engine based on whether a reference position signal that indicates that the rotation angle has passed through the first top dead center is output from the sensor;

when it is determined that the rotation angle has passed through the first top dead center, determining whether or not an amount of forward movement of the engine driven in the forward direction is equal to or greater than an amount of reverse movement of the engine driven in a reverse direction based on a result of detection of the rotation angle by the sensor;

when it is determined that the rotation angle has passed through the first top dead center, and the amount of forward movement is equal to or greater than the amount of reverse movement, determining that a current rotation angle of the engine lies in the intake stroke or the compression stroke and is positioned at a rotation angle shifted from the first top dead center by a difference between the amount of forward movement and the amount of reverse movement detected by the sensor;

when it is determined that the rotation angle has passed through the first top dead center, and the amount of forward movement is not equal to or greater than the amount of reverse movement, determining that the current rotation angle of the engine lies in the combustion stroke or the exhaust stroke and is positioned at a rotation angle shifted from the first top dead center by the difference between the amount of forward movement and the amount of reverse movement detected by the sensor;

when it is determined that the rotation angle has not passed through the first top dead center, determining whether or not the amount of forward movement of the engine driven in the forward direction is equal to or greater than the amount of reverse movement of the engine driven in the reverse direction based on a result of detection of the rotation angle by the sensor;

when it is determined that the rotation angle has not passed through the first top dead center, and the amount of forward movement is equal to or greater than the amount of reverse movement, determining that the current rotation angle of the engine lies in the intake stroke or the compression stroke and is positioned at a rotation angle shifted from a rotation angle shifted from the first top dead center in the forward direction by a first correction amount by the difference between the amount of forward movement and the amount of reverse movement detected by the sensor; and when it is determined that the rotation angle has not passed through the first top dead center, and the amount of forward movement is not equal to or greater than the amount of reverse movement, determining that the current rotation angle of the engine is positioned from a rotation angle shifted from the second top dead center in the reverse direction by a second correction amount by the difference between the amount of forward movement and the amount of reverse movement detected by the sensor, and wherein driving the engine comprising:

starting the forward driving control to start applying a torque to the engine from a motor a rotating shaft of which is connected to a crank shaft of the engine;

measuring a torque application time from the start of application of the torque to the engine;

determining whether or not an rotation number of the engine measured by the sensor has reached a target value;

when it is determined that the rotation number of the engine has not reached the target value, determining whether or not the torque application time has reached a set time and when it is determined that the rotation number of the engine has reached the target value or when it is determined that the torque application time has reached the set time, stopping the forward driving control to stop application of the torque from the motor to the engine, and wherein the torque application time is a time period that the torque applies to the engine.

2. The drive controlling method according to claim 1, wherein when it is determined that the torque application time has not reached the set time, the drive controlling method returns to the determination of whether or not the rotation number of the engine measured by the sensor has reached the target value.

3. The drive controlling method according to claim 1, further comprising:

acquiring a current reference section in which the rotation angle lies after stopping the forward driving control;

measuring a section residence time in which the rotation angle lies in the reference section;

acquiring a current section at present in which the rotation angle lies;

determining whether or not the reference section and the current section are the same;

when it is determined that the reference section and the current section are the same, determining whether or not the section residence time has reached a stop time; and when it is determined that the section residence time has reached the stop time, determining that the engine has stopped rotating.

4. The drive controlling method according to claim 3, wherein when it is determined that the reference section and the current section are not the same, the drive controlling method returns to the step of acquisition of the current reference section in which the rotation angle lies.

5. The drive controlling method according to claim 3, wherein when it is determined that the section residence time has not reached the stop time, the drive controlling method returns to the acquisition of the current section at present in which the rotation angle lies.

6. The drive controlling method according to claim 1, wherein the first correction amount is the difference between a bottom dead center between the intake stroke and the compression stroke and the first top dead center.

7. The drive controlling method according to claim 1, wherein the second correction amount is the difference between bottom dead center between the intake stroke and the compression stroke and the second top dead center.

8. A drive controlling apparatus that controls driving of a four-stroke engine, comprising:

a storage part that stores a map used to control the engine;

an electric power controlling circuit that controls an operation of a motor that applies a torque to the engine; and a CPU that refers to the storage part and controls the electric power controlling circuit to control the motor based on a top dead center and a change of a rotation angle of the engine detected by a sensor, wherein the drive controlling apparatus, performs:

driving the engine in a forward direction by applying a reference torque that exceeds a first top dead center between an exhaust stroke and an intake stroke but does not exceed a second top dead center between a compression stroke and a combustion stroke to the engine in a forward driving control, and then, after the engine stops rotating, determining whether or not the rotation angle has passed through the first top dead center as a result of a forward movement of the engine based on whether a reference position signal that indicates that the rotation angle has passed through the first top dead center is output from the sensor;

when it is determined that the rotation angle has passed through the first top dead center, determining whether or not an amount of forward movement of the engine driven in the forward direction is equal to or greater than an amount of reverse movement of the engine driven in a reverse direction based on a result of detection of the rotation angle by the sensor;

when it is determined that the rotation angle has passed through the first top dead center, and the amount of forward movement is equal to or greater than the amount of reverse movement, determining that a current rotation angle of the engine lies in the intake stroke or the compression stroke and is positioned at a rotation angle shifted from the first top dead center by a difference between the amount of forward movement and the amount of reverse movement detected by the sensor;

when it is determined that the rotation angle has passed through the first top dead center, and the amount of forward movement is not equal to or greater than the amount of reverse movement, determining that the current rotation angle of the engine lies in the combustion stroke or the exhaust stroke and is positioned at a rotation angle shifted from the first top dead center by the difference between the amount of forward movement and the amount of reverse movement detected by the sensor;

when it is determined that the rotation angle has not passed through the first top dead center, determining whether or not the amount of forward movement of the engine driven in the forward direction is equal to or greater than the amount of reverse movement of the engine driven in the reverse direction based on a result of detection of the rotation angle by the sensor;

when it is determined that the rotation angle has not passed through the first top dead center, and the amount of forward movement is equal to or greater than the amount of reverse movement, determining that the current rotation angle of the engine lies in the intake stroke or the compression stroke and is positioned at a rotation angle shifted from a rotation angle shifted from the first top dead center in the forward direction by a first correction amount by the difference between the amount of forward movement and the amount of reverse movement detected by the sensor; and when it is determined that the rotation angle has not passed through the first top dead center, and the amount of forward movement is not equal to or greater than the amount of reverse movement, determining that the current rotation angle of the engine is positioned at a rotation angle shifted from the second top dead center in the reverse direction by a second correction amount by the difference between the amount of forward movement and the amount of reverse movement detected by the sensor, and wherein driving the engine comprising:

starting the forward driving control to start applying a torque to the engine from a motor a rotating shaft of which is connected to a crank shaft of the engine;

measuring a torque application time from the start of application of the torque to the engine;

determining whether or not an rotation number of the engine measured by the sensor has reached a target value;

when it is determined that the rotation number of the engine has not reached the target value, determining whether or not the torque application time has reached a set time and when it is determined that the rotation number of the engine has reached the target value or when it is determined that the torque application time has reached the set time, stopping the forward driving control to stop application of the torque from the motor to the engine, and wherein the torque application time is a time period that the torque applies to the engine.

9. The drive controlling apparatus according to claim 8, wherein the drive controlling apparatus is capable of modifying the first correction amount and the second correction amount.

* * * * *